United States Patent [19]

Pinson

[11] Patent Number: 4,624,424

[45] Date of Patent: Nov. 25, 1986

[54] ON-BOARD FLIGHT CONTROL DRAG ACTUATOR SYSTEM

[75] Inventor: George T. Pinson, Huntsville, Ala.

[73] Assignee: The Boeing Company, Seattle, Wash.

[21] Appl. No.: 669,212

[22] Filed: Nov. 7, 1984

[51] Int. Cl.[4] ..... F42B 15/02; F42B 25/24

[52] U.S. Cl. ..... 244/3.21; 102/384; 102/388; 244/3.28

[58] Field of Search ..... 244/3.21, 3.27, 3.28, 244/3.29; 102/384, 386, 388

[56] References Cited

U.S. PATENT DOCUMENTS

| | | | |
|---|---|---|---|
| 2,520,433 | 8/1950 | Robinson | 244/3.21 |
| 2,941,764 | 6/1960 | Lee, Jr. et al. | 244/3.28 |
| 3,004,489 | 10/1961 | Griffith et al. | 244/3.21 |
| 3,114,315 | 12/1963 | Trump | 102/388 |
| 3,125,313 | 3/1964 | Soderberg | 244/3.21 |
| 3,188,958 | 6/1965 | Burke et al. | 244/3.21 |
| 3,305,194 | 2/1967 | Conard et al. | 244/3.21 |
| 3,343,767 | 9/1967 | Cafissi | 244/3.27 |
| 4,033,525 | 7/1977 | Leonard et al. | 244/3.21 |
| 4,175,491 | 11/1979 | Thomanek | 244/3.27 |

FOREIGN PATENT DOCUMENTS

| | | | |
|---|---|---|---|
| 1188651 | 4/1970 | United Kingdom | 244/3.27 |

*Primary Examiner*—Charles T. Jordan

[57] ABSTRACT

A missile on-board flight pitch, yaw and roll control drag actuator system. The system having a plurality of control panels operated by an actuator drive. The actuator drive accurately positioning the panels in a desired position in the airstream of the missile for controlling the flight, orientation and speed of the aircraft.

3 Claims, 10 Drawing Figures

ON-BOARD FLIGHT CONTROL DRAG ACTUATOR SYSTEM

BACKGROUND OF THE INVENTION

The subject invention provides pitch, yaw and drag control of a missile and the like and more particularly, but not by way of limitation, to an on-board flight control drag actuator system operated by an autopilot control system which monitors the opening and closing of a plurality of control panels which form a part of the missile skin.

Heretofore, there have been various types of drag controls, brake flaps and fin arrangements mounted on the end of a missile for controlling the operation of the missile. These devices and systems are disclosed in the following U.S. patents: U.S. Pat. No. 2,793,591 to Jasse, U.S. Pat. No. 2,941,764 to Lee, Jr. et al, U.S. Pat. No. 2,942,545 to Fogal et al, U.S. Pat. No. 3,004,489 to Griffith el al, U.S. Pat. No. 3,114,315 to Trump, U.S. Pat. No. 3,174,430 to Apotheloz, U.S. Pat. No. 3,188,958 to Burke et al, U.S. Pat. No. 3,343,767 to Cafissi, U.S. Pat. No. 3,588,004 to Suter, U.S. Pat. No. 3,622,103 to Meier.

None of the above mentioned patents provide the unique features and advantages of the subject invention.

SUMMARY OF THE INVENTION

The subject on-board flight control drag actuator system provides a simple and inexpensive method of controlling the flight and orientation of a missile and the like and more particularly can be used effectively at supersonic and hypersonic speeds.

The invention provides both control surfaces and actuators for use in steering the missle in response to control and steering commands.

The actuator system can be used where severe packaging restrictions occur such as in the case of tube launched missiles.

The flight control drag actuator system is effective for speeds of 200 feet per second and greater The on-board flight control drag actuator system for controlling the flight of a missile includes a plurality of control panels hinged to the missile and forming a part of the missile skin. Actuators are connected to each panel for opening and closing the panel into the airstream of the missile. A potentiometer or other positive measuring device is connected to each of actuators for monitoring the position of the control panels. A control system is connected to each potentiometer for determining the position of the panels. A plurality of rate sensors can be connected to the autopilot control system for indicating actual missile or projectile orientation and rate of change of orientation to the autopilot control system.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
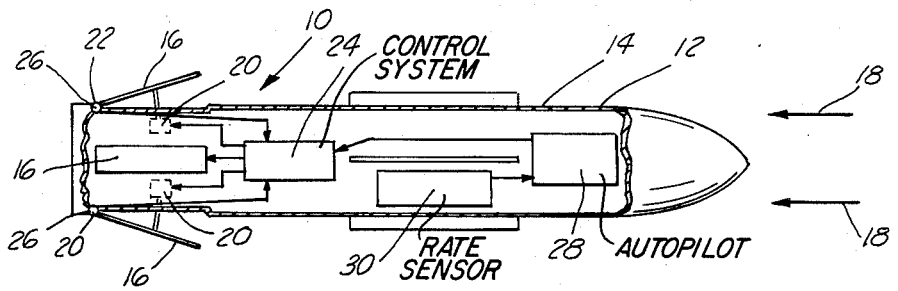
FIG. 1 illustrates a side view of the missile control flight control drag actuator system mounted on a missile.

In FIG. 1 the on-board flight control drag actuator system is designated by general reference numeral 10 and is installed on a missile 12. A portion of a missile skin 14 may be made of a plurality of control panels 16 which are raised into the airstream by an actuator 20 mounted inside the missile 12. The airstream is indicated by arrows 18. The control panels 16 are rotated about a hinge 22 attached to the missile 12. Feedback to a control system 24 is provided by a feedback position measuring device which may be a potentiometer 26 shown in greater detail in FIG. 4.

An autopilot 28 controls the direction and attitude of the missile 12 by monitoring the actual orientation and rate of change of orientation as indicated by rate sensor 30, gyros or similar type of instrumentation. The autopilot 28 is preprogrammed with knowledge of a target's position and reacts and responds to a seeker tracking the target to provide steering commands to the control system 24. The position of the control panels 16 is obtained by monitoring the potentiometer 26. The required positions of the individual control panel 16 are determined and commands issued to the actuators 20 by the control system 24. It should be noted that while the control system 24 and autopilot 28 are shown separately, the control system 24 may be incorporated into the autopilot 28.

Figure 2:
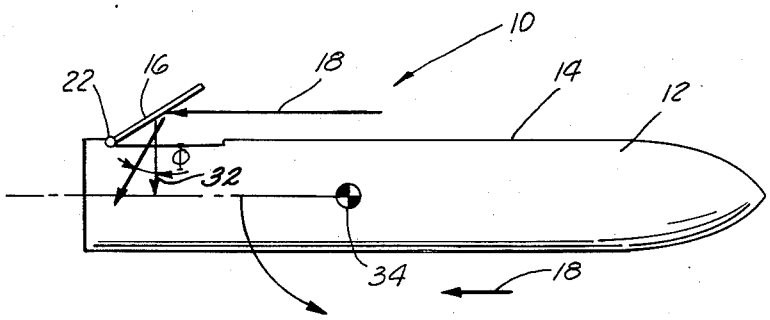
FIG. 2 illustrates the control aspects of the actuator system.

In FIG. 2, the missile 12 is shown and it is assumed in this example, four control panels 16 are used. But, it is recognized, three or more could be used to accomplish the same results. The resultant control forces on the panels 16 are a function of the missile's speed and the effective aerodynamic area of the panels 16. Differential motion of each panel 16 provides total directional control. It is assumed in this example, that the panels 16 are flush with and symetrical with the missile's skin 14 when in a closed position. By biasing the panels 16 several degrees, pitch, yaw and roll control about a turning point indicated by arrow 32 is provided. The missile's center of gravity is indicated by numeral 34.

In FIG. 2 the missile 12 is shown with one of the panels 16 in an erected position. By slanting the panels several degrees, roll control can be provided. In FIG. 2 the panel 16 is slanted an angle $\Phi$.

The opposing panel 16 would also be slanted an equal angle $\Phi$ for roll in a clockwise direction. In this example, the upper and lower panels would be slanted at an equal angle in the opposite direction for roll in a counter clockwise direction. Opening each panel an equal amount would provide for compensating for the roll in opposite directions.

Figure 6:
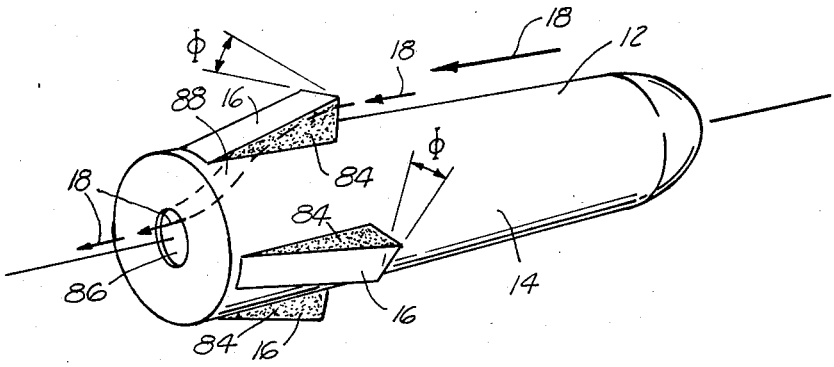
FIG. 6 illustrates a perspective view of the missile using a rigid or flexible skirt material on the control panels.

In FIG. 6 a perspective view of the panel 16 is shown in an erected position on the missile 12 with the upper and lower panels in a forward slanted position and the two panels on the left and right side of the missile in an aft slanted position. The slant angle Φ will be small and in an order of a few degrees. Further each control panel 16 must be slanted enough that both clockwise and counter clockwise control is provided by the opening and closing of the individual panels 16. The roll control is built in and is not changed during the flight of the missile 12.

Figure 3A:
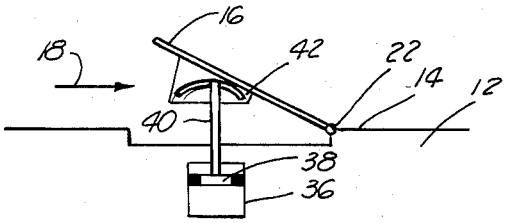
FIGS. 3A, 3B, 3C and 3D illustrate the various embodiments of the actuator for driving the control panels.
Figure 3B:
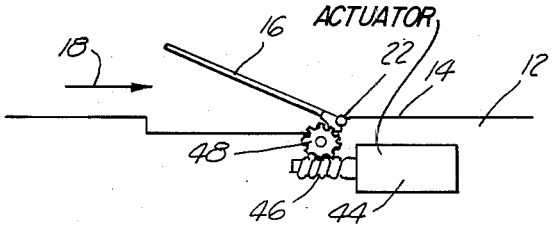
Figure 3C:
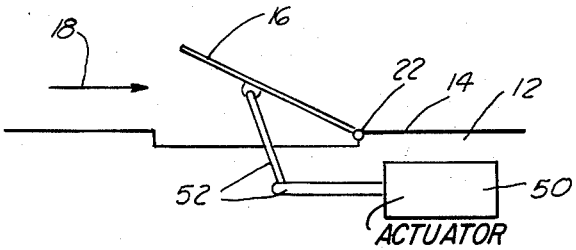
Figure 3D:
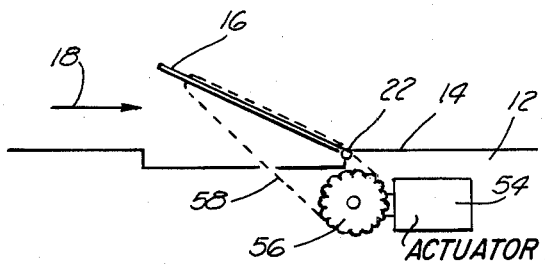

The following discussion describes various types of actuators 20 that could be used equally well in opening and closing the panels 16. In FIG. 3A, one example of movement of the control panel 16 is shown. A single piston actuator 36 is shown having a piston 38 with piston rod 40 used for moving the panel 16 with guide 42. In FIG. 3B a worm driven actuator is shown having an actuator 44 with worm gear 46 used for driving a gear section 48 attached to the panel 16. In FIG. 3C, a folding hinge actuator is used having an actuator 50 with folding hinge 52 attached to the panel 16. In FIG. 3D a cable drive actuator is shown having an actuator 54 connected to a sprocket 56 received around an endless control cable 58 mounted on the panel 16. It should be noted that all of the above actuators are designed to open the leading edge of the panels 16 into the airstream 18.

Figure 4:
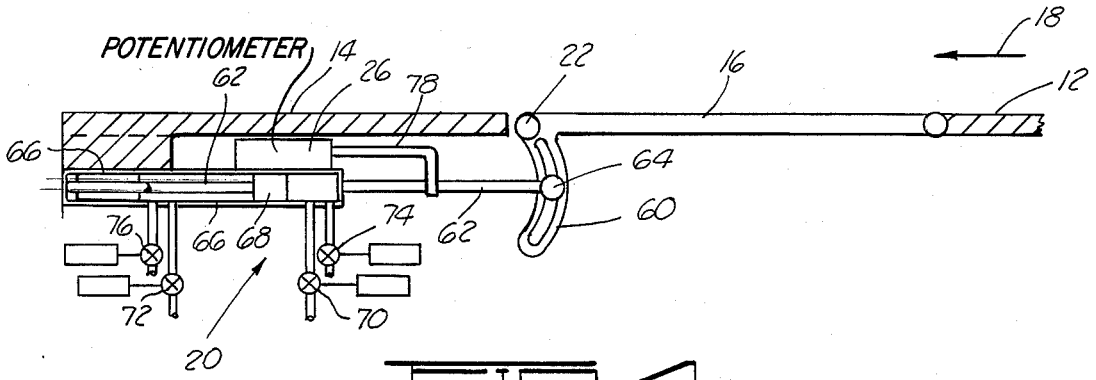
FIG. 4 illustrates a preferred embodiment of the actuator.

In FIG. 4 a preferred embodiment of the actuator 20 is shown. In this illustration, the control panel 16 is part of the missile skin 14. The control panel 16 is attached to the hinge 22 which is in turn connected to a slide lever 60. The slide lever 60 is curved such that an actuator rod 62 applies force perpendicular to the slide lever 60 at all points of travel. The actuator rod 62 is attached to the slide lever 60 by an attachment clip 64.

The potentiometer 26 is attached to a two-way actuator drive 66 having a piston 68 received therein with one end of the actuator rod 62 attached to the piston 68. The two-way actuator drive 66 is operated by high pressure gas stored on board the missile 12.

The piston 68 is operated using the high pressure gas and by opening and closing exhaust valves 70 and 72 and inlet valves 74 and 76.

The potentiometer 26 includes a movable arm 78 attached to the actuator rod 62. The potentiometer arm 78 moves with the rod 62. This provides information of the position of the actuator rod at all times. The potentiometer 26 provides feedback data to the control system 24.

The two-way actuator drive 66 as mentioned above is operated by opening, either partially or all the way, one of the two inlet valves 74 and 76 and opening one of the exhaust valves 70 or 72.

In this design the actuator rod 62 is moved towards the front of the missile 12 when the drag control panel 16 is deployed. The airstream direction is such that the control panel will be opened by the aerodynamic forces after the panel is exposed to the airstream. The actuator 20 is strongest on the closing cycle where the actuator rod 62 is being shortened. This is desirable since the actuator 20 must work against the aerodynamic forces during the closing of the panels 16.

In the control of small missiles, especially the terminally guided missile class in the range of four inches in diameter and 24 inches long, it may be necessary to deploy a parachute or ballute to slow the missile to a relatively slow speed so that time is available for target search and acquisition.

Figure 5A:
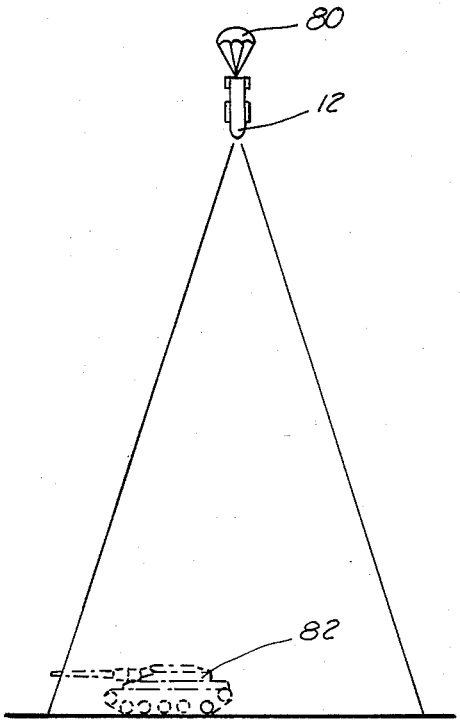
FIG. 5A illustrates the use of a parachute for missile speed reduction.
Figure 5B:
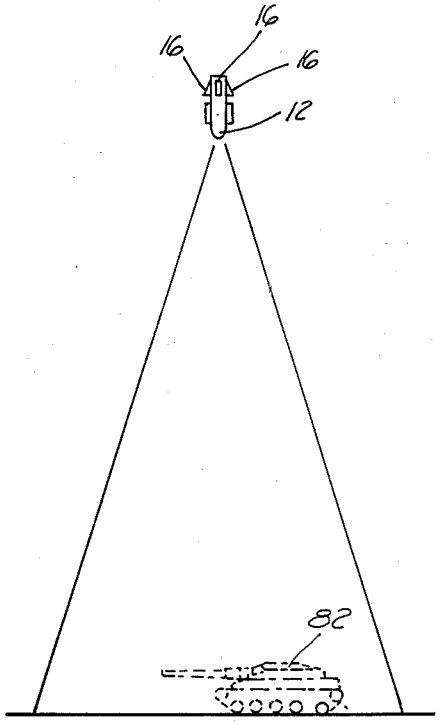
FIG. 5B illustrates the missile speed reduction using the drag control panels.

The subject invention has the advantages in that the deployment of all four of the control panels 16 will accomplish the same results as a parachute or the like without incurring additional costs and with no decrease in realiability. This is shown in FIGS. 5A and 5B where one missile 12 has a parachute 80 and the other missile 12 has the control panel 16 accomplishing the same results in attacking a target 82.

In FIG. 6 the on-board flight control drag actuator system 10 can be improved by the addition of the use of a flexible or rigid material 84 attached to the sides of the control panel 16. When the panels 16 are deployed, the material 84 provides a skirt. The skirt 84 is firmly attached to the missile skin 14 and the sides of the panels 16. The skirt 84 is ballooned by the airstream pressure similar to a parachute or ballute. Also, by placing an orifice 86 in the rear of the missile 12 and an internal air flow cavity 88, air will be directed through the rear of the missile 12 and outwardly without resultant undesirable side forces.

It can be appreciated, by reviewing the above mentioned drawings, the on-board flight control drag actuator system 10 provides an inexpensive, simplified missile control system which can be used effectively for high rates of speed and likewise provide control surfaces and actuators for rapid response in the steering and flight control of the missile.

Changes may be made in the construction and arrangement of the parts or elements of the embodiments as described herein without departing from the spirit or scope of the invention defined in the following claims.

What is claimed is:

1. An on-board flight pitch, yaw and roll control drag actuator system for controlling the flight of a missile, the system comprising:

a plurality of control panels hinged on the missile;

an actuator connected to each pannel for opening and closing the panels into the airstream of the missile, the actuator connected to the panel using a two-way actuator drive with a gas operated piston mounted therein, the piston having an actutor rod extending outwardly therefrom, the end of the actuator rod connected to a slide lever attached to a hinged joint mounted at one end of the control panel, the two-way actuator drive, when actuated by compressed gas, moving the actuator rod which in turn rotates the slide lever and hinged joint thereby raising the control panel into the airstream and lowering the control panel into a closed position;

a feedback position measuring device connected to the panels for monitoring the position of the panels; and an autopilot control system connected to each actuator and feedback position measuring device and programmed for determining the required position of the control panels.

2. An on-board flight pitch, yaw and roll control drag actuator system for controlling the flight of a missile, the system comprising:

a plurality of control panels hinged on the missile, the control panels including flexible skirt material mounted along the sides thereof for directing airflow downwardly through a portion of the missile and outwardly through the rear of the missile, the skirt ballooned by the airstream pressure with the skirt acting as a parachute or ballute;

an actuator connected to each panel for opening and closing the panel into the airstream of the missile;

a feedback position measuring device connected to the panels for monitoring the position of the panels; and an autopilot control system connected to each actuator and feedback position measuring device and programmed for determining the required position of the control panels.

3. An on-board flight control drag actuator system controlling the flight of a missile, the system comprising:

a plurality of control panels hinged on the missile and having flexible skirts mounted along the sides of the control panel, the control panel with skirts directing the flow downwardly through a portion of the missile and out the rear of the missile;

an actuator connected to each control panel for opening and closing the panel into the airstream of the missile, the actuator having a two-way actuator drive driven by high pressure gas stored in the missile, the actuator drive having a piston received therein with an actuator rod extending outwardly therefrom, the actuator rod slidably engaging a slide lever, the slide lever attached to a hinged joint mounted on one end of the control panel, the movement of the actuator rod moving the slide lever for raising and lowering the control panel on the hinged joint;

a potentiometer connected to the actuator rod for monitoring the position of the panels as they are raised and lowered in the airstream;

an autopilot control system connected to the actuator and the potentiometer for determining the required position of the panels; and a rate sensor connected to the autopilot control system for indicating the actual orientation and rate of change of orientation of the missile to the autopilot control system.

* * * * *